US007770772B2

(12) United States Patent
Adams

(10) Patent No.: US 7,770,772 B2
(45) Date of Patent: Aug. 10, 2010

(54) JET PUMP COOLING SYSTEM FOR COMBUSTION-POWERED FASTENER-DRIVING TOOLS

(75) Inventor: Joseph S. Adams, British Columbia (CA)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/976,894

(22) Filed: Oct. 29, 2007

(65) Prior Publication Data

US 2008/0110333 A1 May 15, 2008

Related U.S. Application Data

(60) Provisional application No. 60/858,358, filed on Nov. 13, 2006.

(51) Int. Cl.
*B25C 1/08* (2006.01)

(52) U.S. Cl. ..... 227/130; 227/8; 123/46 SC

(58) Field of Classification Search ..... 227/8, 227/10, 130; 123/46 SC, 46 R, 260
See application file for complete search history.

(56) References Cited

U.S. PATENT DOCUMENTS 4,365,471 A * 12/1982 Adams ..... 60/39.76
4,422,498 A * 12/1983 Chen ..... 165/47
4,665,868 A 5/1987 Adams
4,759,318 A 7/1988 Adams
5,197,646 A * 3/1993 Nikolich ..... 227/8
5,377,628 A 1/1995 Adams
5,713,313 A * 2/1998 Berry ..... 123/46 SC
6,164,510 A * 12/2000 Deieso et al. ..... 227/130
6,491,002 B1 * 12/2002 Adams ..... 123/46 R
6,634,325 B1 * 10/2003 Adams ..... 123/46 R
6,874,452 B2 * 4/2005 Adams ..... 123/46 R
6,912,988 B2 * 7/2005 Adams ..... 123/256
7,040,261 B2 * 5/2006 Granacher et al. ..... 123/46 SC
7,063,052 B2 6/2006 Nishikawa et al.
7,063,053 B2 * 6/2006 Hirai et al. ..... 123/46 SC
2005/0173489 A1 8/2005 Shkolnikov et al.
2006/0225676 A1 * 10/2006 Hirai et al. ..... 123/46 H

FOREIGN PATENT DOCUMENTS

EP 1595653 11/2005

* cited by examiner

*Primary Examiner*—Rinaldi I. Rada
*Assistant Examiner*—Nathaniel Chukwurah
(74) *Attorney, Agent, or Firm*—Law Offices of Steven W. Weinrieb

(57) ABSTRACT

A cooling system for combustion-powered fastener-driving tools comprises the use of cooling fin structures upon the external wall members of the combustion chamber and cylinder. Fluid flow paths are constructed between internal wall portions of a surrounding tool housing and the cooling fin structures mounted upon the external wall members of the combustion chamber and cylinder. In this manner, ambient cooling air is passed over and through the cooling fin structures whereby the combustion chamber and cylinder components of the fastener-driving tool are efficiently cooled such that the temperature level of the fastener-driving tool is maintained at a desirable temperature level despite the substantial amount of heat normally generated during each combustion cycle.

22 Claims, 9 Drawing Sheets

JET PUMP COOLING SYSTEM FOR COMBUSTION-POWERED FASTENER-DRIVING TOOLS

CROSS-REFERENCE TO RELATED PATENT APPLICATION

This patent application is related to, based upon, and effectively a utility patent application conversion from U.S. Provisional Patent Application Ser. No. 60/858,358, which was filed on Nov. 13, 2006, the filing date benefits of which are hereby incorporated by reference.

FIELD OF THE INVENTION

The present invention relates generally to combustion-powered fastener-driving tools, and more particularly to a new and improved cooling system for combustion-powered fastener-driving tools wherein the new and improved cooling system can more efficiently cool the fastener-driving tool and thereby maintain the fastener-driving tool at a desirable temperature level despite the substantial amount of heat normally generated during each combustion cycle.

BACKGROUND OF THE INVENTION

Combustion-powered fastener-driving tools are of course well-known in the art and basically comprise a combustion chamber, within which a fuel-air mixture is adapted to be ignited, and a piston-cylinder assembly disposed in communication with the combustion chamber. The piston-cylinder assembly comprises a piston member, movably disposed within a cylinder and having, for example, a first surface portion oriented toward or facing the combustion chamber such that the air-fuel mixture disposed and combusted within the combustion chamber can act upon the piston member thereby forcing the same to move from its initial, retracted START position to its subsequent, extended DRIVEN position, and a driver blade integrally connected to a second surface portion of the piston member and adapted to encounter and drive a fastener component out from the fastener-driving tool. During the combustion phase of the combustion-powered cycle, when the air-fuel mixture is ignited, a substantial amount of heat is normally generated, however, it is extremely important to adequately cool the fastener-driving tool in order to ensure the fact that the fastener-driving tool will continue to perform properly. More particularly, it is important to properly cool such combustion-powered fastener-driving tools in order to achieve and maintain desirable power and cyclic speed levels characteristic of such tools. For example, when the tool is not properly or sufficiently cooled whereby the prevailing temperature level of the tool is excessive, the proper or desired amount or volume of air or oxygen is not able to be charged into the combustion chamber. Accordingly, the stoichiometric ratio of the air-fuel mixture will not be as desired or required, and therefore, the power output parameters or characteristics of the tool will not be achieved. As a result of the power output parameters or characteristics of the tool not being able to be achieved, in accordance with the tool specifications, the fasteners will not be able to be properly driven into their substrates to the desired insertion level. In other words, for example, the head portions of the fasteners will project above the external surface of the substrate as opposed to being properly driven into the substrates such that the head portions of the fasteners will be flush with or embedded within the external surface of the substrate. In a similar manner, when the tool is not properly or sufficiently cooled whereby the prevailing temperature level of the tool is excessive, the exhaust gases or residual air disposed within the combustion chamber are not condensed to the desired degree. Accordingly, the piston is not able to be fully returned to its initial or START position at the commencement of a new tool firing cycle. Not only will this, again, potentially affect the power output of the tool in view of the fact that the drive piston will not be able to achieve a full and complete power stroke, but in addition, the cyclic timing or operational speed of the machine will be retarded. Still yet further, the tool may also be subjected to misfiring.

Accordingly, a need exists in the art for a new and improved cooling system for combustion-powered fastener-driving tools wherein the new and improved cooling system can more efficiently cool the fastener-driving tool and thereby maintain the fastener-driving tool at a desirable temperature level despite the substantial amount of heat normally generated during each combustion cycle.

SUMMARY OF THE INVENTION

The foregoing and other objectives are achieved in accordance with the teachings and principles of the present invention through the provision of a new and improved jet pump cooling system, for use in connection with combustion-powered fastener-driving tools, wherein the new and improved jet pump cooling system comprises the provision of cooling fin structure upon the external wall surface portions of both the combustion chamber and the cylinder of the piston-cylinder assembly. In addition, an external tool shroud or housing surrounds or encases the combustion chamber and cylinder so as to define, in effect, a radially oriented cylindrical space, and an axially oriented annular space, between the external wall surface portions of the combustion chamber and cylinder, and the internal wall surface portions of the tool shroud or housing, wherein the axially oriented annular space is fluidically connected to the radially oriented cylindrical space. Cooling air is adapted to be conducted through the radially and axially oriented spaces so as to perform a heat exchange process with respect to the cooling fin structures of the combustion chamber and cylinder, and a jet pump is fluidically connected to the axially oriented annular space, while an air inlet port is fluidically connected to either the radially oriented cylindrical space or to the axially oriented annular space, in order to provide the desired fluid flow within the radially oriented cylindrical space and the axially oriented annular space so as to achieve the afore-noted heat exchange cooling process, particularly during the power stroke of the drive piston. A thermally controlled fan may be disposed within the jet pump section of the cooling system, and the fin structures, formed or disposed upon the external wall portions of the combustion chamber and cylinder, may be disposed in a circumferentially overlapped manner so as to maximize the surface area of the cooling fin structure while minimizing the overall radial or diametrical extent of the tool.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 5, is disposed within the lower end wall member of the cylinder, the exhaust port, defined within the lower side wall portion of the cylinder so as to exhaust air, disposed beneath the piston member, toward the jet pump, has also been eliminated, however, an exhaust port is defined within an oppositely disposed lower side wall portion of the cylinder so as to be fluidically connected to a nozzle member which, in turn, is fluidically connected to the annular space defined between the external tool housing and the cooling fin structures integrally incorporated upon the external annular wall portions of the combustion chamber and cylinder whereby ambient cooling air will effectively be entrained into the annular space defined between the external tool housing and the cooling fin structures integrally incorporated upon the external annular wall portions of the combustion chamber and cylinder so as to be conducted toward and through the cooling fin structures integrally incorporated upon the external annular wall portions of the combustion chamber and cylinder in a substantially fluid-pushing mode as opposed to a fluid-pulling mode of operation.

DETAILED DESCRIPTION OF THE PREFERRED EMBODIMENT

Figure 1:
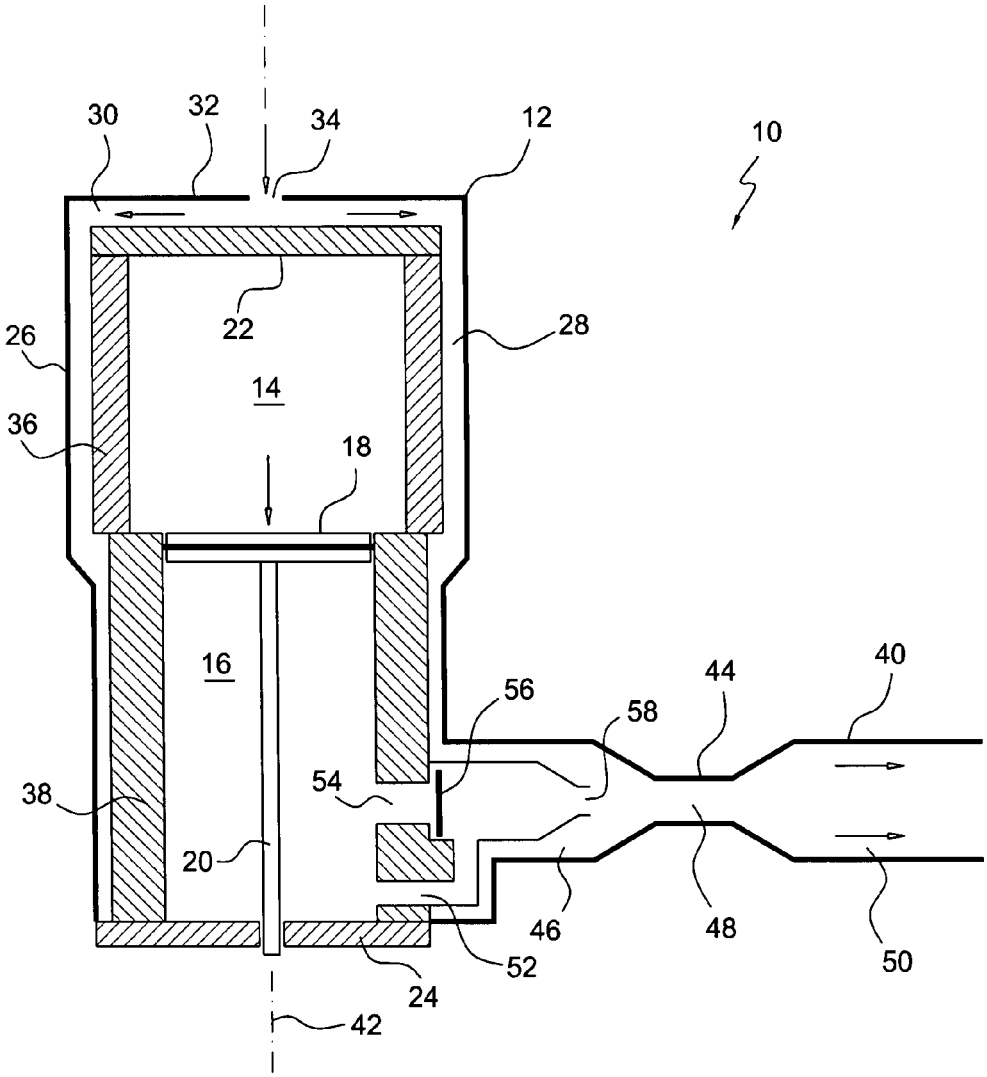
FIG. 1 is a schematic cross-sectional view of a first embodiment of a new and improved jet pump cooling system for use in connection with a combustion-powered fastener-driving tool, as constructed in accordance with the principles and teachings of the present invention, wherein the combustion chamber and cylinder have cooling fin structures integrally incorporated upon the external annular wall portions thereof, wherein a jet pump is fluidically connected to the lower downstream end portion of the cylinder, and wherein the piston member is disposed at its initial START position prior to the ignition of an air-fuel mixture within the combustion chamber.
Figure 2:
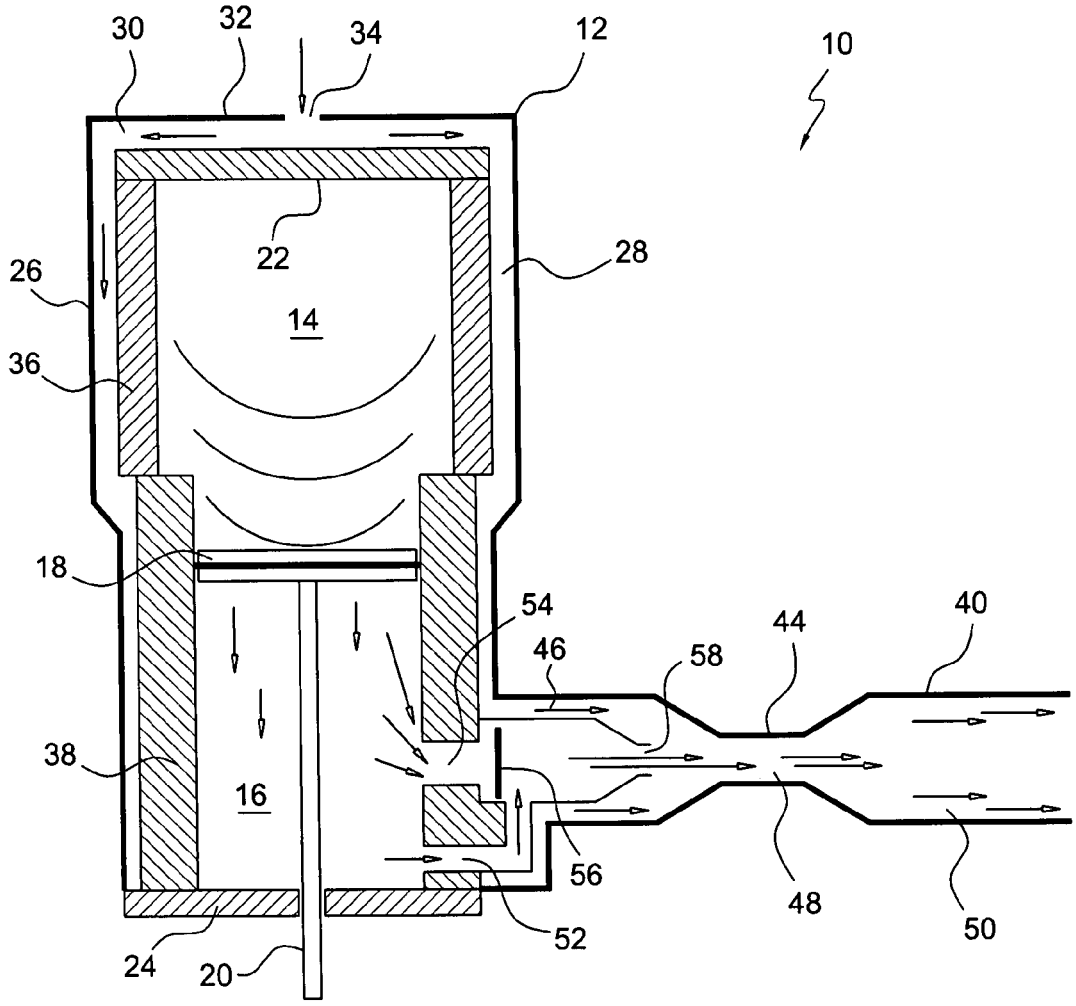
FIG. 2 is a schematic cross-sectional view of the first embodiment of the new and improved jet pump cooling system for use in connection with the combustion-powered fastener-driving tool as disclosed within FIG. 1, wherein, however, the air-fuel mixture has been ignited within the combustion chamber such that the piston member has begun to move downwardly, as viewed within the drawings, air initially disposed beneath the piston member is being compressed and exhausted out from the cylinder and through the jet pump, and the drop in pressure and rise in velocity characteristic of the fluid flow through the venturi portion of the jet pump causes ambient cooling air to be drawn through an air inlet defined within the upper end portion of the tool housing and conducted toward and through the cooling fin structures integrally incorporated upon the external annular wall portions of the combustion chamber and cylinder.

Referring now to the drawings, and more particularly to FIGS. 1-4 thereof, a first embodiment of a new and improved jet pump cooling system, for use in connection with a combustion-powered fastener-driving tool, and as constructed in accordance with the principles and teachings of the present invention, is disclosed and is generally indicated by the reference character 10. More particularly, a combustion-powered fastener-driving tool 12 is seen to comprise an upper annular combustion chamber 14 and a lower annular cylinder 16 wherein the upper end portion of the cylinder 16 is fixedly and fluidically connected to the lower end portion of the combustion chamber 14. A piston member 18 is disposed within the upper end portion of the cylinder 16 so as to normally be substantially disposed at the interface defined between the lower end portion of the combustion chamber 14 and the upper end portion of the cylinder 16 at the commencement of a power stroke, and in this manner, the upper surface portion of the piston member 18 is oriented toward or faces the interior of the combustion chamber 14 so as to be acted upon by the combustion gases when an air-fuel mixture is ignited within the combustion chamber 14. A driver blade 20 is fixedly connected to the under surface portion of the piston member 18, and consequently, when the piston member 18 is moved downwardly under the influence of the combustion gases generated within the combustion chamber 14, the driver blade 20 will encounter and drive a fastener out from the fastener-driving tool 12. It is of course also noted that the upper end portion of the combustion chamber 14 is closed by means of a top wall member 22, while, in a similar manner, the lower end portion of the cylinder 16 is closed by means of a bottom wall member 24, except for the fact that the driver blade 20 passes through the bottom wall member 24.

An annular external shroud or housing 26 is disposed in an axially and radially spaced manner with respect to the combustion chamber 14 and the cylinder 16 so as to define a first axially oriented annular space 28 between the external peripheries of the combustion chamber 14 and the cylinder 16, and the internal wall surface of the annular shroud or housing 26, as well as a second radially oriented cylindrical space 30 between the top wall member 22 of the combustion chamber 14 and the top wall member 32 of the housing 26, wherein the second cylindrical space 30 is fluidically connected to the first annular space 28, and an air inlet port 34 is defined within an upper central portion of the tool shroud or housing 26 so as to be fluidically connected to the cylindrical space 30. In addition, and in accordance with further principles and teachings of the first embodiment of the new and improved jet pump cooling system 10 of the present invention for use in connection with the combustion-powered fastener-driving tool 12, it is also to be appreciated that the external peripheral portions of the combustion chamber 14 comprise cooling fin structure 36, and in a similar manner, the external peripheral portions of the cylinder 16 also comprise cooling fin structure 38. Furthermore, and in accordance with yet additional principles and teachings of the first embodiment of the new and improved jet pump cooling system 10 of the present invention for use in connection with the combustion-powered fastener-driving tool 12, it is also seen that the external shroud or housing 26 comprises a section 40 which extends radially outwardly from, or with respect to, the primary tool shroud or housing 26 so as to be oriented substantially perpendicular to the longitudinal axis 42 of the tool 12.

More particularly, the radially outwardly extending external shroud or housing section 40 is adapted to comprise or define the jet pump assembly 44 of the overall jet pump cooling system 10 of the present invention wherein the jet pump assembly 44 comprises a first relatively large diameter upstream section 46 fluidically connected at its upstream end portion to the first axially oriented annular space 28, a second relatively small diameter venturi section 48 fluidically connected at its upstream end portion to the downstream end portion of the first relatively large diameter section 46, and a third relatively large diameter downstream outlet section 50 fluidically connected at its upstream end portion to the second relatively small diameter venturi section 48. In addition, a first permanently open exhaust port 52 is defined within a lower side wall portion of the cylinder 16, and a second exhaust port 54, controlled by means of an exhaust check valve 56, is also defined within a side wall portion of the cylinder 16 at an axial position upstream of the first permanently open exhaust port 52. Still yet further, a nozzle member 58 envelops or encases both the first permanently open exhaust port 52 and the second exhaust port 54 such that the downstream discharge end portion of the nozzle member 58 fluidically discharges toward and into the venturi section 48 of the jet pump assembly 44. Accordingly, it can be appreciated that, with reference continuing to be made to FIGS. 1-4, when an air-fuel mixture is introduced into the combustion chamber 14 and ignited, the expansion of the combustible products, and the rise in pressure, within the combustion chamber 14 will force the piston member 18 to move downwardly from its initial or START position as illustrated within FIG. 1 to an intermediate position as illustrated within FIG. 2.

Accordingly, as the piston member 18 moves downwardly, air disposed within the cylinder and beneath the piston member 18 begins to be compressed and is directed outwardly through the first permanently open exhaust port 52 as well as through the second exhaust port 54 as a result of the check valve 56 having been unseated and opened. The exhausted air is conducted toward and through the nozzle member 58 which, in turn, conducts the exhausted air toward and into the venturi section 48 of the jet pump assembly 44. As the exhausted air passes through the venturi section 48, it will be characterized by means of a drop in pressure and an increase in velocity whereby ambient cooling air will be drawn or induced into the tool housing 26 through means of the air inlet port 34. The incoming ambient cooling air enters the cylindrical air space 30 and is subsequently conducted into the annular air space 28 so as to pass through and around the cooling fin structures 36,38, respectively formed upon the external wall portions of the combustion chamber 14 and cylinder 16, thereby performing a heat exchange function with respect to the combustion chamber 14 and the cylinder 16 so as to effectively cool the same and thereby ensure that the temperature level of such tool components is maintained at a desirable relatively low value. As the ambient cooling air continues to flow through the tool housing 26, it is entrained with the air exhausted from the nozzle member 58, passes through the venturi section 48 of the jet pump assembly 44, and is exhausted through the outlet section 50 of the jet pump assembly 44.

Figure 3:
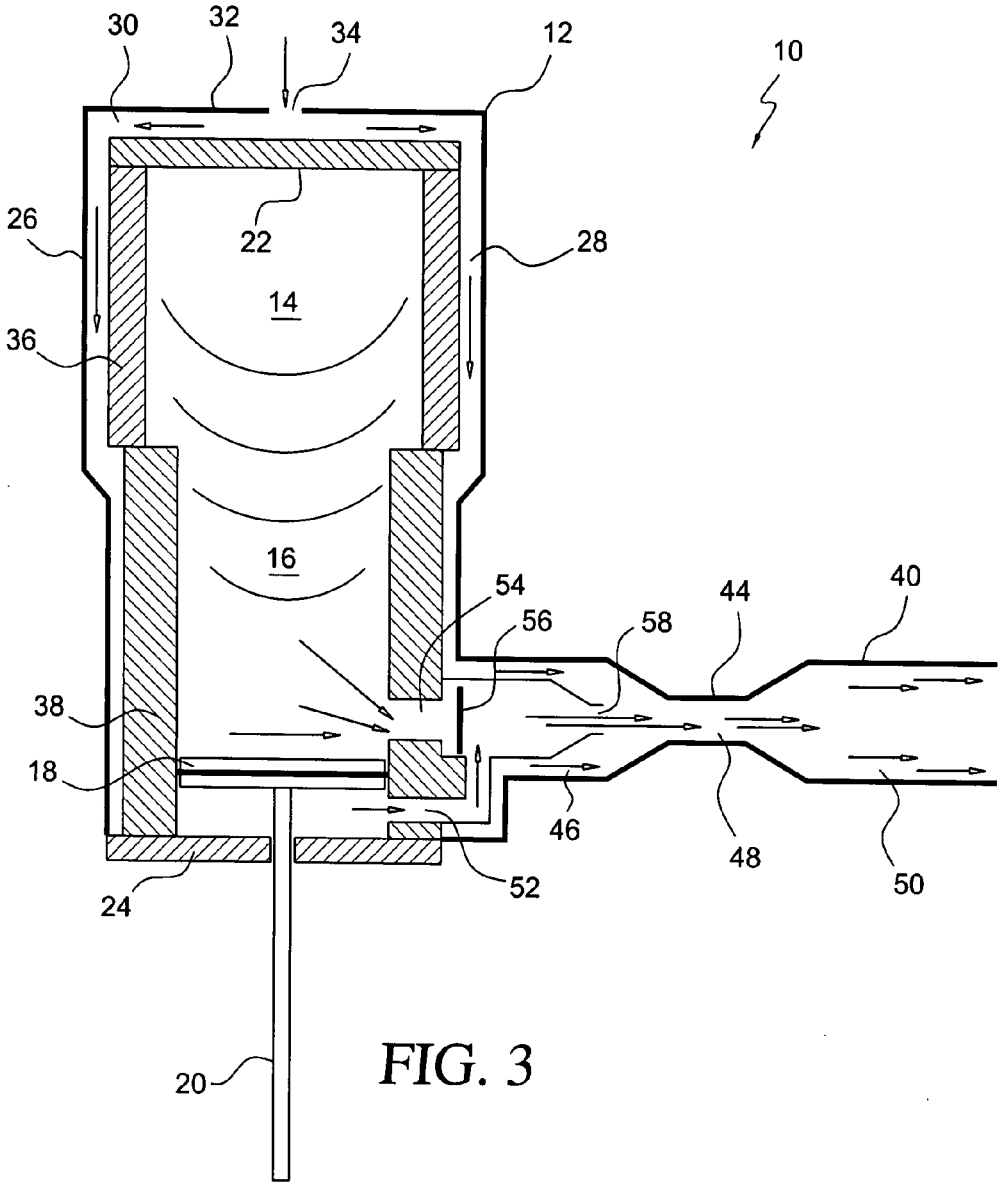
FIG. 3 is a schematic cross-sectional view of the first embodiment of the new and improved jet pump cooling system for use in connection with the combustion-powered fastener-driving tool as disclosed within FIGS. 1 and 2, wherein, however, the piston member has now reached the bottom of its stroke and has effectively bypassed the exhaust check valve whereby exhaust gases are now conducted outwardly through the nozzle member of the jet pump so as to further increase the volume of ambient cooling air being drawn through the air inlet defined within the upper end portion of the tool housing and conducted toward and through the cooling fin structures integrally incorporated upon the external annular wall portions of the combustion chamber and cylinder.
Figure 4:
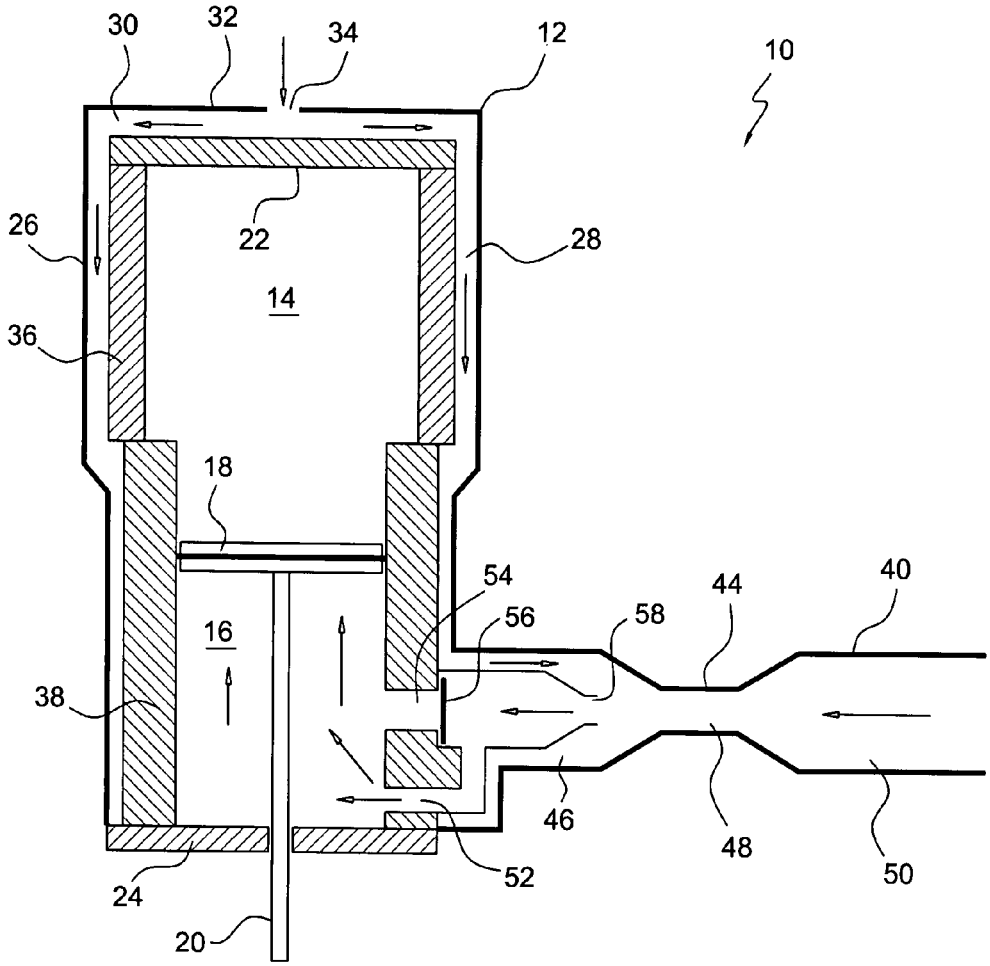
FIG. 4 is a schematic cross-sectional view of the first embodiment of the new and improved jet pump cooling system for use in connection with a combustion-powered fastener-driving tool as disclosed within FIGS. 1-3, wherein, however, the piston member has begun its return stroke such that ambient cooling air, in addition to being drawn through the air inlet defined within the upper end portion of the tool housing and conducted toward and through the cooling fin structures integrally incorporated upon the external annular wall portions of the combustion chamber and cylinder, is also drawn in, in a reverse mode, through the venturi portion of the jet pump and into the cylinder space disposed beneath the piston member.

Continuing further, and with reference being made specifically to FIG. 3, as the piston member 18 reaches the bottom of its stroke, the piston member 18 effectively by-passes the second exhaust port 54 whereby exhaust gases from the combustion chamber and the upper end portion of the cylinder 16 are now exhausted through means of the second exhaust port 54. Accordingly, this increases the volume of fluid flow through jet pump assembly 44 with a consequent increase in volume of fluid flow of the incoming ambient cooling air. Continuing still further, and with reference being made specifically to FIG. 4, as the piston member 18 begins its return stroke, check valve 56 is again seated and closed, and fresh or ambient air is drawn backwardly through the jet pump assembly 44 in the reverse direction so as to enter the lower end portion of the cylinder 16, and beneath the rising piston member 18, through means of the first permanently open exhaust port 52. In addition, since the cylindrical space 30 and the annular space 28 are still fluidically connected to the jet pump assembly 44, ambient cooling air, which has continued to enter the upper region of the tool housing 26 through means of the inlet port 34, is effectively entrained with the fresh air, being conducted in the reverse direction through the jet pump assembly 44 and into the lower end portion of the cylinder 16, as a result of effectively flowing in the reverse direction into and through the nozzle member 58. It can therefore be readily appreciated that not only is ambient cooling air provided to the cooling fin structures 36,38 of the combustion chamber 14 and cylinder 16 during the downward power stroke of the piston member 18, but such ambient cooling air is also provided to the cooling fin structures 36, 38 of the combustion chamber 14 and cylinder 16 during the upward return stroke of the piston member 18.

Figure 5:
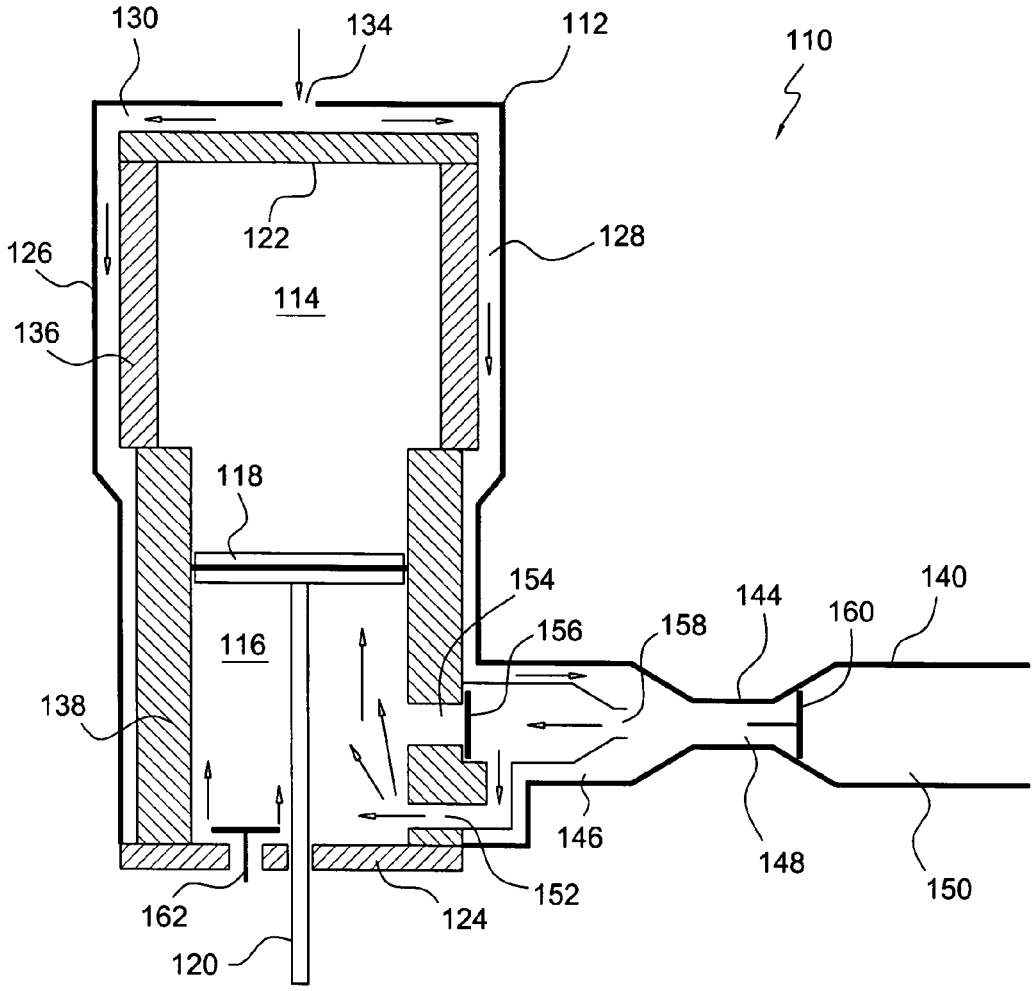
FIG. 5 is a schematic cross-sectional view, similar to that of FIG. 4, showing, however, a second embodiment of a new and improved jet pump cooling system for use in connection with a combustion-powered fastener-driving tool, as constructed in accordance with the principles and teachings of the present invention, wherein a first auxiliary check valve is disposed within the jet pump section of the cooling system at a position downstream of the venturi portion of the jet pump such that the air flowing into the lower end of the cylinder, and beneath the returning piston member, must be drawn through the air inlet, defined within the upper end portion of the tool housing, and conducted toward and through the cooling fin structures integrally incorporated upon the external annular wall portions of the combustion chamber and cylinder, and wherein, still further, an inlet check valve may also be disposed within the lower end wall member of the cylinder so as to enable additional fresh air to be conducted into the lower end portion of the cylinder during the piston return stroke.

With reference now being made to FIG. 5, a second embodiment of a new and improved jet pump cooling system for use in connection with a combustion-powered fastener-driving tool, as constructed in accordance with the principles and teachings of the present invention, is disclosed and is generally indicated by the reference character 110. It is to be noted that since the structural composition of the second embodiment of the new and improved jet pump cooling system 110 is similar to the first embodiment of the new and improved jet pump cooling system 10, component parts of the second embodiment of the new and improved jet pump cooling system 110 which correspond to similar component parts of the first embodiment of the new and improved jet pump cooling system 10 will be designated by corresponding reference numbers except that they will be within the 100 series. In addition, it is also noted that for brevity purposes, only those structural features, characteristic of the second embodiment of the new and improved jet pump cooling system 110, which differ from the structural features characteristic of the first embodiment of the new and improved jet pump cooling system 10, will be discussed in detail. Accordingly, and more particularly, it is seen that in accordance with the second embodiment of the new and improved jet pump cooling system 110 of the present invention, a first auxiliary check valve member 160 is disposed within the jet pump assembly 144 at a position down-stream of the venturi section 148 of the jet pump assembly 144 such that when the piston member 118 undergoes its upward return stroke, the fresh air flowing into the lower end portion of the cylinder 116, and beneath the upwardly moving piston member 118, is not drawn in through the outlet section 150 of the jet pump assembly 114, but to the contrary, is, as was the case of the first embodiment of the new and improved jet pump cooling system 10, as illustrated within FIG. 4, drawn in as the ambient cooling air through the air inlet port 134 defined within the upper end portion of the tool housing 126.

Accordingly, not only is such fresh air conducted into the lower end portion of the cylinder 116, but it is also conducted through the cooling fin structures 136,138 integrally incorporated upon the external annular wall portions of the combustion chamber 114 and cylinder 116. In addition, a second auxiliary check valve, in the form of an inlet check valve 162, may also be disposed or incorporated within the lower end wall member 124 of the cylinder 116 so as to enable additional fresh air to be conducted into the lower end portion of the cylinder 116 during the piston return stroke. It is lastly noted that, as was the case with the first embodiment of the new and improved jet pump cooling system 10 as illustrated within FIG. 4, not only is ambient cooling air provided to the cooling fin structures 136,138 of the combustion chamber 114 and cylinder 116 during the downward power stroke of the piston member 118, but such ambient cooling air is also provided to the cooling fin structures 136,138 of the combustion chamber 114 and cylinder 116 during the upward return stroke of the piston member 118.

Figure 6:
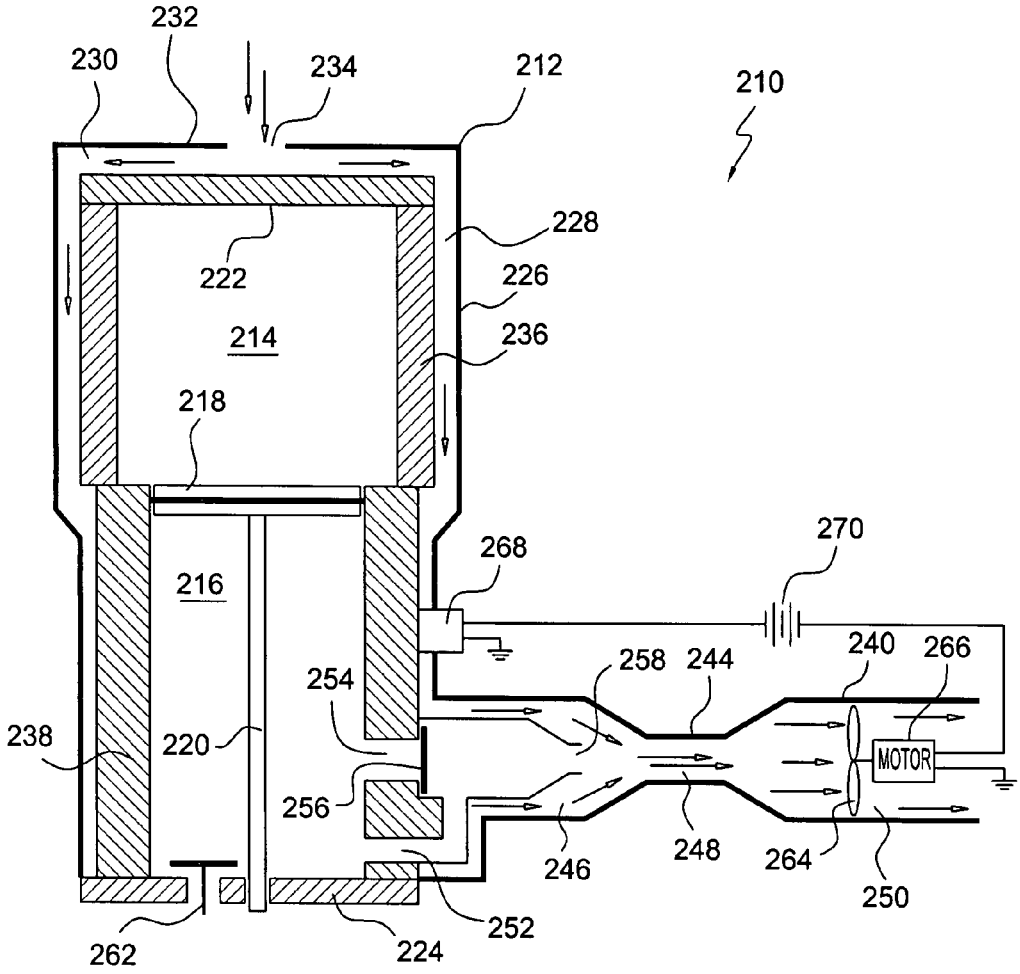
FIG. 6 is a schematic cross-sectional view, similar to that of FIG. 5, showing, however, a third embodiment of a new and improved jet pump cooling system for use in connection with a combustion-powered fastener-driving tool, as constructed in accordance with the principles and teachings of the present invention, wherein, in lieu of the first auxiliary check valve being disposed within the jet pump section of the cooling system at the position downstream of the venturi portion of the jet pump, a motor-driven fan, controlled by means of a thermal switch, is located at such position so as to be fluidically connected to the annular space defined between the external tool housing and the cooling fin structures integrally incorporated upon the external annular wall portions of the combustion chamber and cylinder whereby ambient cooling air will be drawn through the air inlet defined within the upper end portion of the tool housing and conducted toward and through the cooling fin structures integrally incorporated upon the external annular wall portions of the combustion chamber and cylinder when the temperature of the tool, as sensed by means of the thermal switch, reaches a predeterminedly excessive temperature level.

With reference now being made to FIG. 6, a third embodiment of a new and improved jet pump cooling system for use in connection with a combustion-powered fastener-driving tool, as constructed in accordance with the principles and teachings of the present invention, is disclosed and is generally indicated by the reference character 210. It is to be noted that since the structural composition of the third embodiment of the new and improved jet pump cooling system 210 is similar to that of the first and second embodiments of the new and improved jet pump cooling system 10,110, component parts of the third embodiment of the new and improved jet pump cooling system 210 which correspond to similar component parts of the first and second embodiments of the new and improved jet pump cooling systems 10,110 will be designated by corresponding reference numbers except that they will be within the 200 series. In addition, it is also noted that for brevity purposes, only those structural features, characteristic of the third embodiment of the new and improved jet pump cooling system 210, which differ from the structural features characteristic of the first and second embodiments of the new and improved jet pump cooling system 10,110, will be discussed in detail. Accordingly, and more particularly, it is seen that the third embodiment of the new and improved jet pump cooling system 210 of the present invention is similar to the second embodiment of the new and improved jet pump cooling system 110 as disclosed within FIG. 5, however, in lieu of the first auxiliary check valve 160 being disposed within the jet pump assembly 144 of the jet pump cooling system 110 at the position downstream of the venturi section 148 of the jet pump assembly 144, a cooling fan 264 is located within the outlet section 250 of the jet pump assembly 244. The cooling fan 264 is operatively connected to a drive motor 266, and the drive motor 266 is, in turn, operatively connected to a thermal switch mechanism 268 which is fixedly mounted, for example, upon an external wall portion of the cylinder 216 so as to in fact determine or sense the temperature level, although, of course, the thermal switch mechanism 268 may also be mounted upon the external wall portion of the combustion chamber 214. Electrical power for the thermal switch mechanism 268 is supplied by means of the tool battery 270, and accordingly, if the sensed temperature reaches a predeterminedly selected excessive temperature level, the thermal switch mechanism 268 will activate the drive motor 266 so as to, in turn, activate the cooling fan 264. Accordingly, ambient cooling air will be drawn into the tool housing 226 through means of the inlet port 234, cylindrical space 230, and annular space 228 so as to pass through and around the cooling fin structures 236,238 respectively formed upon the external annular wall portions of the combustion chamber 214 and 216.

It can of course be further appreciated that when the cooling fan 264 is not activated, the third embodiment of the new and improved jet pump cooling system 210 of the present invention will effectively operate in a manner similar to that of the second embodiment of the new and improved jet pump cooling system 110 as disclosed within FIG. 5 except for the fact that when the piston member 218 is moved upwardly during its return stroke, fresh air will in fact be drawn inwardly through the outlet section 250 of the jet pump assembly 244 in view of the fact that the first auxiliary check valve 160 of the jet pump cooling system 110 has been eliminated. In addition, as was the case with the second embodiment of the new and improved jet pump cooling system 110 of the present invention, as disclosed within FIG. 5, it is also to be appreciated that not only is ambient cooling air therefore provided to the cooling fin structures 236,238 of the combustion chamber 214 and cylinder 216 during the downward power stroke of the piston member 218, but such ambient cooling air is also provided to the cooling fin structures 236, 238 of the combustion chamber 214 and cylinder 216 during the upward return stroke of the piston member 218.

Figure 7:
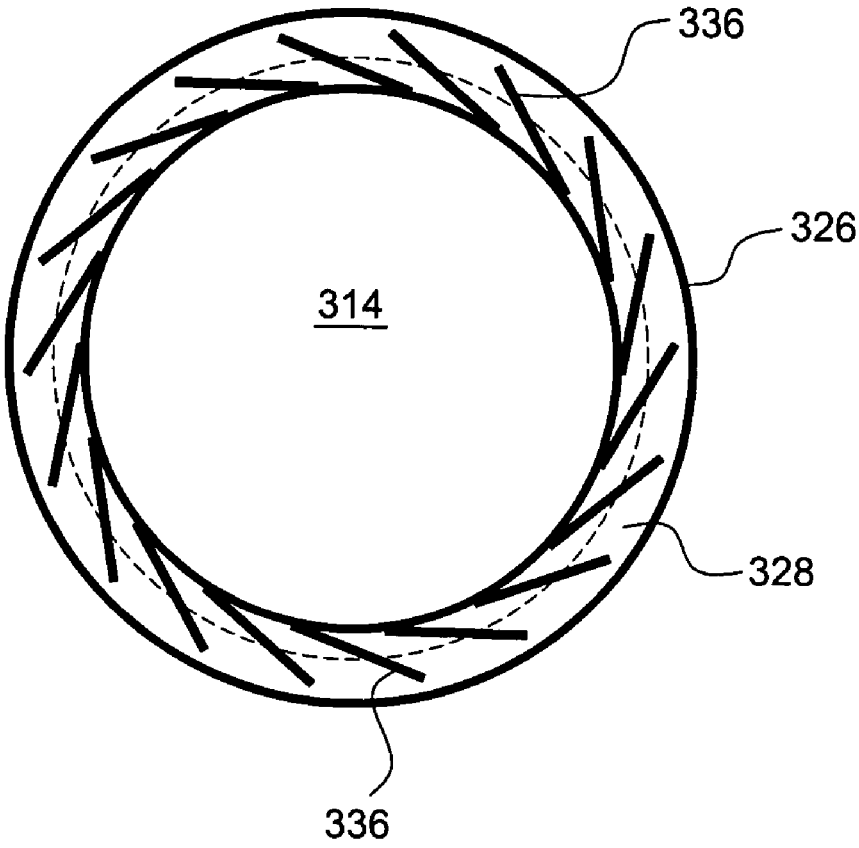
FIG. 7 is a cross-sectional view showing a modified embodiment of the plurality of cooling fins, as disposed upon and forming the cooling fin structures integrally incorporated upon the external annular wall portions of the combustion chamber and cylinder, wherein, in lieu of the cooling fins extending radially outwardly so as to have a predetermined radial or diametrical extent, the cooling fins may be disposed within a substantially circumferentially overlapped array whereby the surface area of the cooling fins is effectively maximized while the radial or diametrical extent of the tool may be substantially reduced.

Continuing further, and with reference now being made to FIG. 7, there is disclosed a modified embodiment of the cooling fins 336 forming, for example, the cooling fin structures integrally incorporated upon the external annular wall portions of the combustion chamber 314 of the particular fastener-driving tool, it of course being appreciated that similarly configured cooling fins can likewise be employed upon the cylinder portion of the fastener-driving tool. More particularly, it is seen that the plurality of cooling fins 336 are disposed within the annular space 328 defined between the peripheral wall portion of the combustion chamber 314 and the surrounding tool shroud or housing 326, and in lieu of the cooling fins extending radially outwardly so as to have a predetermined radial or diametrical extent substantially perpendicular to the longitudinal axis of the combustion chamber 314, the cooling fins 336 are disposed within a substantially circumferentially overlapped array whereby the surface area of the cooling fins 336 is effectively maximized while the radial or diametrical extent of the cooling fins 336, and the resulting radial or diametrical extent of the fastener-driving tool, is substantially reduced. In this manner, maximized, or at least adequate or sufficient cooling of the fastener-driving tool can nevertheless be achieved without rendering the size of the fastener-driving tool problematic.

Figure 8:
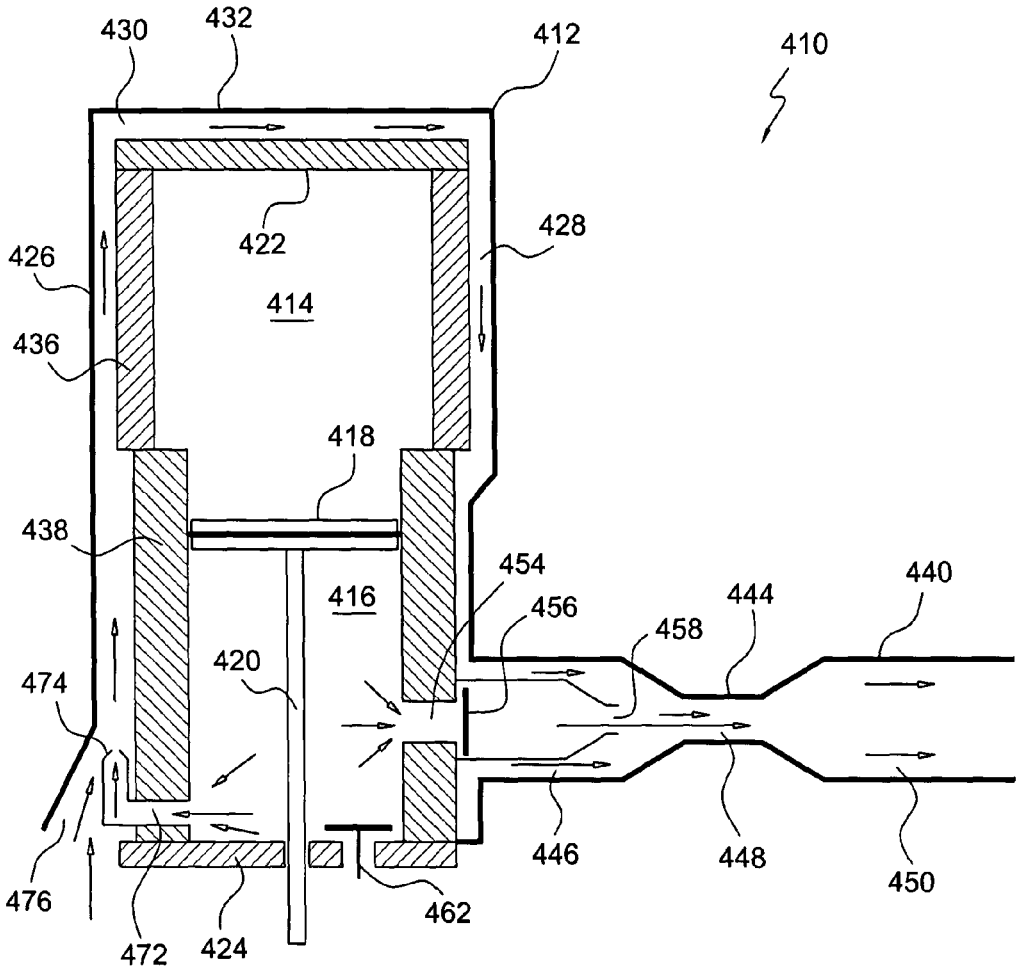
FIG. 8 is a schematic cross-sectional view, some-what similar to that of FIG. 5, showing, however, a fourth embodiment of a new and improved jet pump cooling system for use in connection with a combustion-powered fastener-driving tool, as constructed in accordance with the principles and teachings of the present invention, wherein it is seen that the air inlet, defined within the upper end portion of the tool housing, has been eliminated, an inlet check valve, similar to the inlet check valve incorporated within the second embodiment jet pump cooling system, as disclosed within

Considering now the jet pump cooling system as disclosed within FIG. 8, a fourth embodiment of a new and improved jet pump cooling system for use in connection with a combustion-powered fastener-driving tool, and somewhat similar to the first and second embodiment jet pump cooling systems as disclosed within FIGS. 1 and 5, is disclosed and is generally indicated by the reference character 410. As was the case with the several previous embodiments, it is to be noted that since the structural composition of the fourth embodiment of the new and improved jet pump cooling system 410 is similar to those of the first and second embodiments of the new and improved jet pump cooling system 10,110, component parts of the fourth embodiment of the new and improved jet pump cooling system 410 which correspond to similar component parts of the first and second embodiments of the new and improved jet pump cooling systems 10,110 will be designated by corresponding reference numbers except that they will be within the 400 series. In addition, it is also noted that for brevity purposes, only those structural features, characteristic of the fourth embodiment of the new and improved jet pump cooling system 410, which differ from the structural features characteristic of the first and second embodiments of the new and improved jet pump cooling system 10,110, will be discussed in detail. Accordingly, and more particularly, it is seen that the jet pump assembly 444 of the fourth embodiment of the new and improved jet pump cooling system 410 is similar to the jet pump assembly 44 of the first embodiment of the new and improved jet pump cooling system 10 as disclosed within FIG. 1, however, the permanently open exhaust port 52 of the first embodiment jet pump cooling system 10 has been eliminated.

In addition, it is seen that an inlet check valve 462, similar to the inlet check valve 162 of the second embodiment jet pump cooling system 110 as disclosed within FIG. 5, is provided within the bottom end wall member 424 of the cylinder 416, and still further, an exhaust port 472 and an exhaust nozzle 474 are defined within a side wall portion of the cylinder 416 which is disposed substantially opposite the exhaust port 454. It is seen that the exhaust nozzle 474 is fluidically connected to the annular space 428 defined between the tool shroud or housing 426 and the external wall surface portion of the cylinder 416, and that an air inlet 476 effectively surrounds the exhaust nozzle 474 such that fresh, incoming ambient air can be fluidically provided and conducted into the annular space 428 as a result of being effectively entrained within the exhaust air flow discharged by means of exhaust nozzle 474. It is also noted that the air inlet port 34, as provided within the upper end wall member 32 of the tool shroud or housing 26, as disclosed within the first embodiment jet pump cooling system as illustrated within FIG. 1, has been eliminated. In this manner, it is to be appreciated that when the piston member 418 is moved downwardly during a power stroke, the air beneath the piston member 418 will not only be discharged through means of the jet pump assembly 444, but in addition, a portion of such air will also be exhausted through means of the exhaust port 472 and the exhaust nozzle 474 so as to effectively entrain fresh incoming ambient cooling air through means of the air inlet 476. Such fresh incoming ambient cooling air will of course traverse the annular space 428 and the cylindrical space 430, in a substantially fluid-pushing mode of operation, thereby imparting a heat exchange cooling operation with respect to the cooling fin structures 436,438 respectively incorporated upon the combustion chamber 414 and cylinder 416.

Figure 9:
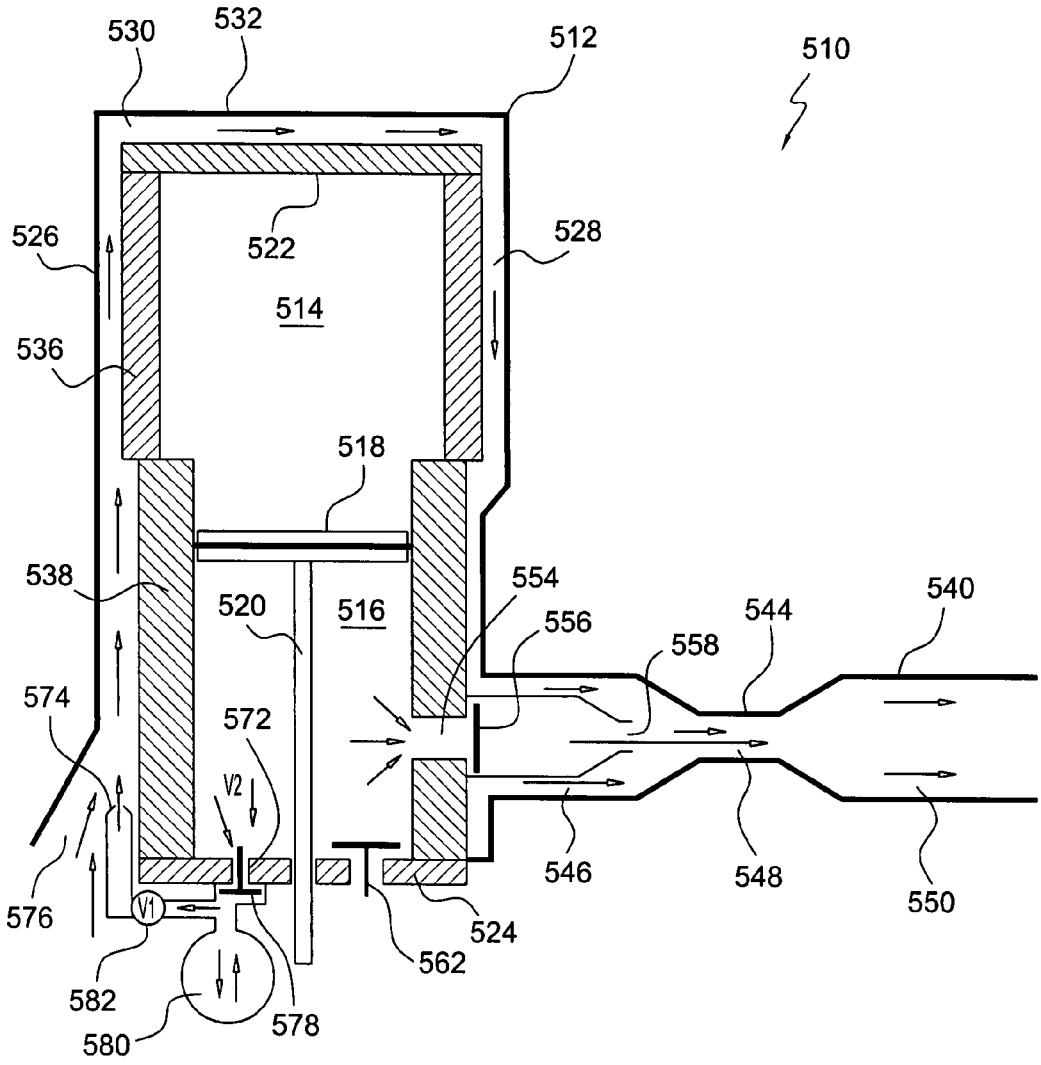
FIG. 9 is a schematic cross-sectional view, similar to that of FIG. 8, showing, however, a fifth embodiment of a new and improved jet pump cooling system for use in connection with a combustion-powered fastener-driving tool, as constructed in accordance with the principles and teachings of the present invention, wherein it is seen that the exhaust port, in lieu of being defined within the lower side wall portion of the cylinder, is defined within the lower end wall member of the cylinder and has a plenum storage chamber, controlled by means of a check valve, operatively associated therewith for storing air there within that was originally disposed beneath the piston member and exhausted from the cylinder during the downward stroke of the piston member, and wherein further, a second control valve is disposed within the fluid conduit fluidically connecting the plenum storage chamber with the nozzle member which exhausts air into the annular space defined between the external tool housing and the cooling fin structures integrally incorporated upon the external annular wall portions of the combustion chamber and cylinder so as to effectively entrain incoming ambient cooling air therewith.

With reference lastly being made to FIG. 9, a fifth embodiment of a new and improved jet pump cooling system for use in connection with a combustion-powered fastener-driving tool, as constructed in accordance with the principles and teachings of the present invention, is disclosed and is generally indicated by the reference character 510. It is seen that the fifth embodiment jet pump cooling system 510 is similar to the fourth embodiment jet pump cooling system 410 as disclosed within FIG. 8, and therefore, component parts of the fifth embodiment jet pump cooling system 510 which correspond to similar component parts of the fourth embodiment jet pump cooling systems 410 will be designated by corresponding reference numbers except that they will be within the 500 series. In addition, it is also noted that for brevity purposes, only those structural features, characteristic of the fifth embodiment jet pump cooling system 510, which differ from the structural features characteristic of the fourth embodiment jet pump cooling system 410, will be discussed in detail. Accordingly, and more particularly, it is seen that the exhaust port 572, in lieu of being defined within the lower side wall portion of the cylinder 516, is defined within the lower end wall member 524 of the cylinder 516, and an outlet check valve 578 is operatively associated with the exhaust port 572. In addition, it is also seen that a plenum storage chamber 580 is fluidically connected to the exhaust port 572, through means of the outlet check valve 578, and still further, the plenum storage chamber 580 is also fluidically connected to the exhaust nozzle 574 through means of a control valve 582. In this manner, depending upon the degree to which the control valve 582 is opened or closed, a predetermined volume of air, disposed beneath the piston member 518 and exhausted outwardly from the lower end portion of the cylinder as a result of the downward movement of the piston member 518 within the cylinder 516 during a power stroke, can not only be stored within the plenum chamber 580, but in addition, can also be controllably introduced into and conducted through the exhaust nozzle 574 so as to entrain incoming fresh ambient cooling air through air inlet 576 over an extended period of time so as to further enhance the cooling effect impressed upon the cooling fin structures 536,538 of the combustion chamber 514 and cylinder 516.

Thus, it may be seen that in accordance with the principles and teachings of the present invention, there has been disclosed several different embodiments of a new and improved cooling system for combustion-powered fastener-driving tools wherein the new and improved cooling system comprises the use of cooling fin structures upon the external wall members of the combustion chamber and cylinder. Fluid flow paths are constructed between internal wall portions of a surrounding tool shroud or housing and the cooling fin structures mounted upon the external wall members of the combustion chamber and cylinder. In this manner, ambient cooling air is passed over and through the cooling fin structures whereby the combustion chamber and cylinder components of the fastener-driving tool are efficiently cooled such that the temperature level of the fastener-driving tool is maintained at a desirable temperature level despite the substantial amount of heat normally generated during each combustion cycle.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A cooling system, for a combustion-powered tool, comprising:

a cylinder having a longitudinal axis;

a piston movably disposed within a piston chamber defined within said cylinder;

a combustion chamber, having a longitudinal axis, connected to said cylinder and within which forces and heat are cyclically generated for impacting upon said piston so as to move said piston within said cylinder;

a housing externally surrounding external wall portions of said combustion chamber and said cylinder of said combustion-powered tool so as to define an annular cooling air space between internal wall portions of said housing and said external wall portions of said combustion chamber and said cylinder whereby said annular cooling air space externally surrounds said combustion chamber and said cylinder;

a cooling air inlet defined upon said housing and fluidically connected to said annular cooling air space externally surrounding said combustion chamber and said cylinder for permitting cooling air to enter said annular cooling air space externally surrounding said combustion chamber and said cylinder; and an air outlet, fluidically connected to both said annular cooling air space externally surrounding said combustion chamber and said cylinder, and said piston chamber, for inducing ambient cooling air to enter said cooling air inlet and to flow into and solely through said annular cooling air space externally surrounding said combustion chamber and said cylinder as air, disposed within said piston chamber and beneath said piston disposed within said piston chamber, is exhausted out from said piston chamber and out through said air outlet as said piston is moved within said piston chamber during a power stroke of said piston of said combustion-powered tool, such that said cooling air, flowing solely within said annular cooling air space, flows past said external wall portions of said combustion chamber and said cylinder and thereby cools said combustion chamber and said cylinder.

2. The cooling system as set forth in claim 1, wherein:

said air outlet comprises a jet pump assembly.

3. The cooling system as set forth in claim 2, wherein:

said jet pump assembly comprises a venturi section for creating a drop in pressure and an increase in velocity of exhaust gas from said cylinder through said venturi section of said jet pump assembly whereby ambient cooling air will be induced into said housing through said cooling air inlet.

4. The cooling system as set forth in claim 1, further comprising:

a fan operatively mounted within said air outlet;

a drive motor operatively connected to said fan for driving said fan when said drive motor is activated; and a thermal switch mounted upon an external wall portion of one of the cylinder and chamber components of combustion-powered tool for sensing the temperature level of the one of said cylinder and chamber components of said combustion-powered tool and for activating said drive motor if said sensed temperature level of said one of said cylinder and chamber components of said combustion-powered tool exceeds a predetermined excessive temperature level.

5. The cooling system as set forth in claim 1, further comprising:

a nozzle member mounted upon said cylinder for exhausting air from said cylinder and entraining ambient cooling air into said space defined between said internal wall portions of said housing and said external wall portions of said combustion chamber and said cylinder.

6. The cooling system as set forth in claim 5, further comprising:

a storage plenum chamber fluidically connected to said nozzle member and adapted to store air exhausted from said cylinder; and a control valve operatively associated with said storage plenum chamber for controlling the amount of air discharged from said storage plenum chamber and fluidically conducted to said nozzle member so as to control said entraining of said ambient cooling air into said space defined between said internal wall portions of said housing and said external wall portions of said combustion chamber and said cylinder.

7. The cooling system as set forth in claim 1, further comprising:

cooling structure mounted upon external wall portions of said combustion chamber and said cylinder for facilitating cooling of said combustion chamber and said cylinder.

8. The cooling system as set forth in claim 7, wherein:

said cooling structure mounted upon the external wall portions of said combustion chamber and said cylinder comprise cooling fins.

9. The cooling system as set forth in claim 8, wherein:

said cooling fins extend radially outwardly from said external wall portions of said combustion chamber and said cylinder so as to extend substantially perpendicular to said longitudinal axes of said combustion chamber and said cylinder.

10. The cooling system as set forth in claim 8, wherein:

said cooling fins are disposed within a circumferentially overlapped array so as to effectively reduce the radial and diametrical extent of said combustion-powered tool.

11. The cooling system as set forth in claim 7, wherein:

said air outlet is fluidically connected to said annular space, defined between said internal wall portions of said housing and said external wall portions of said combustion chamber and said cylinder, for inducing ambient cooling air to enter said cooling air inlet and said annular space, defined between said internal wall portions of said housing and said external wall portions of said combustion chamber and said cylinder, as said piston is moved within said cylinder during a return stroke of said piston of said combustion-powered tool, so as to pass by said cooling structure mounted upon said external wall portions of said combustion chamber and said cylinder and thereby cool said combustion chamber and said cylinder.

12. The cooling system as set forth in claim 1, further comprising:

cooling structure mounted upon external wall portions of said combustion chamber and said cylinder for facilitating cooling of said combustion chamber and said cylinder.

13. The fastener-driving tool as set forth in claim 12, wherein:

said cooling structure mounted upon said external wall portions of said chamber and said cylinder comprise cooling fins.

14. The fastener-driving tool as set forth in claim 13, wherein:

said cooling fins extend radially outwardly from said external wall portions of said chamber and said cylinder so as to extend substantially perpendicular to said longitudinal axes of said chamber and said cylinder.

15. The fastener-driving tool as set forth in claim 13, wherein:

said cooling fins are disposed within a circumferentially overlapped array so as to effectively reduce the radial and diametrical extent of said fastener-driving tool.

16. The fastener-driving tool as set forth in claim 12, wherein:

said air outlet is fluidically connected to said space, defined between said internal wall portions of said housing and said external wall portions of said combustion chamber and said cylinder, for inducing ambient cooling air to enter said cooling air inlet and said space, defined between said internal wall portions of said housing and said external wall portions of said combustion chamber and said cylinder, and to pass by said cooling structure mounted upon said external wall portions of said chamber and said cylinder so as to cool said chamber and said cylinder as said piston is moved within said cylinder during a return stroke of said piston of said fastener-driving tool.

17. A fastener-driving tool, comprising:

a cylinder having a longitudinal axis;

a piston movably disposed within a piston chamber defined within said cylinder;

a driver blade fixedly attached to said piston for driving a fastener our from said fastener-driving tool;

a combustion chamber, having a longitudinal axis, connected to said cylinder and within which forces and heat are cyclically generated for impacting upon said piston so as to move said piston within said cylinder whereby said driver blade can drive a fastener out from said fastener-driving tool;

a housing externally surrounding external wall portions of said combustion chamber and said cylinder of said fastener-driving tool so as to define an annular cooling air space between internal wall portions of said housing and said external wall portions of said combustion chamber and said cylinder whereby said annular cooling air space externally surrounds said combustion chamber and said cylinder;

a cooling air inlet defined upon said housing and fluidically connected to said annular cooling air space externally surrounding said combustion chamber and said cylinder for permitting cooling air to enter said annular cooling air space externally surrounding said combustion chamber and said cylinder; and an air outlet, fluidically connected to both said annular cooling air space externally surrounding said combustion chamber and said cylinder, and said piston chamber, for inducing ambient cooling air to enter said cooling air inlet and to flow into and solely through said annular cooling air space externally surrounding said combustion chamber and said cylinder as air, disposed within said piston chamber and beneath said piston disposed within said piston chamber, is exhausted out from said piston chamber and out through said air outlet as said piston is moved within said piston chamber of said cylinder during a power stroke of said piston of said fastener-driving tool, such that said cooling air, flowing solely within said annular cooling air space, flows past said external wall portions of said combustion chamber and said cylinder and thereby cools said combustion chamber and said cylinder.

18. The fastener-driving tool as set forth in claim 17, wherein:

said air outlet comprises a jet pump assembly.

19. The fastener-driving tool as set forth in claim 18, wherein:

said jet pump assembly comprises a venturi section for creating a drop in pressure and an increase in velocity of exhaust gas from said cylinder through said venturi section of said jet pump assembly whereby ambient cooling air will be induced into said housing through said cooling air inlet.

20. The fastener-driving tool as set forth in claim 17, further comprising:

a fan operatively mounted within said air outlet;

a drive motor operatively connected to said fan for driving said fan when said drive motor is activated; and a thermal switch mounted upon an external wall portion of one of said cylinder and chamber components of said fastener-driving tool for sensing the temperature level of said one of said cylinder and chamber components of said fastener-driving tool and for activating said drive motor if said sensed temperature level of said one of said cylinder and chamber components of said fastener-driving tool exceeds a predetermined excessive temperature level.

21. The fastener-driving tool as set forth in claim 17, further comprising:

a nozzle member mounted upon said cylinder for exhausting air from said cylinder and entraining ambient cooling air into said space defined between said internal wall portions of said housing and said external wall portions of said combustion chamber and said cylinder.

22. The fastener-driving tool as set forth in claim 21, further comprising:

a storage plenum chamber fluidically connected to said nozzle member and adapted to store air exhausted from said cylinder; and a control valve operatively associated with said storage plenum chamber for controlling the amount of air discharged from said storage plenum chamber and fluidically conducted to said nozzle member so as to control said entraining of said ambient cooling air into said space defined between said internal wall portions of said housing and said said external wall portions of said combustion chamber and said cylinder.

* * * * *